US011763985B2

(12) United States Patent
Takatsu

(10) Patent No.: US 11,763,985 B2
(45) Date of Patent: Sep. 19, 2023

(54) METHOD OF MANUFACTURING COIL COMPONENT

(71) Applicant: Murata Manufacturing Co., Ltd., Kyoto-fu (JP)

(72) Inventor: Keisuke Takatsu, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 474 days.

(21) Appl. No.: 17/035,594

(22) Filed: Sep. 28, 2020

(65) Prior Publication Data

US 2021/0098189 A1 Apr. 1, 2021

(30) Foreign Application Priority Data

Sep. 30, 2019 (JP) ..... 2019-180182

(51) Int. Cl.

| | |
|---|---|
| ***H01F 7/06*** | (2006.01) |
| ***H01F 41/02*** | (2006.01) |
| ***H01F 27/28*** | (2006.01) |
| ***H01F 17/04*** | (2006.01) |
| ***H01F 27/29*** | (2006.01) |

(52) U.S. Cl.

CPC ..... *H01F 41/0246* (2013.01); *H01F 17/045* (2013.01); *H01F 27/2866* (2013.01); *H01F 27/292* (2013.01); *H01F 41/0233* (2013.01)

(58) Field of Classification Search

CPC .... H01F 17/04; H01F 17/045; H01F 27/2866; H01F 27/292; H01F 27/306; H01F 41/0246; H01F 2017/048

See application file for complete search history.

(56) References Cited

U.S. PATENT DOCUMENTS

| | | | | |
|---|---|---|---|---|
| 10,614,950 | B2 * | 4/2020 | Ahn | H01F 27/2823 |
| 11,276,519 | B2 * | 3/2022 | Shinohara | H01F 17/0013 |
| 2003/0222340 | A1 * | 12/2003 | Kondo | H05K 3/4617 257/E23.06 |
| 2016/0035477 | A1 * | 2/2016 | Yeh | H01F 38/14 320/108 |

FOREIGN PATENT DOCUMENTS

| | | | |
|---|---|---|---|
| JP | 2016167578 | A | 9/2016 |
| JP | 2017037947 | A | 2/2017 |
| JP | 2017-123433 | A | 7/2017 |
| JP | 2019106482 | A | 6/2019 |

* cited by examiner

*Primary Examiner* — Paul D Kim

(74) *Attorney, Agent, or Firm* — Studebaker & Brackett PC

(57) ABSTRACT

A method of manufacturing a coil component includes arranging a plurality of coil conductors that is a wound body of a conductive wire, and each has opposing first and second surfaces, in a winding axis direction on a surface of an adhesive layer in contact with the first surface, manufacturing a processed body by placing a first magnetic sheet including a first metal magnetic particle and a first resin on a side of the second surface of each of the coil conductors and performing press processing on the first magnetic sheet, manufacturing an aggregate base body by peeling the processed body from the adhesive layer, placing a second magnetic sheet including a second metal magnetic particle and a second resin on a side of the first surface of each coil conductor, and press processing the second magnetic sheet, and manufacturing a body by individualizing the aggregate base body.

6 Claims, 6 Drawing Sheets

METHOD OF MANUFACTURING COIL COMPONENT

CROSS-REFERENCE TO RELATED APPLICATION

This application claims benefit of priority to Japanese Patent Application No. 2019-180182, filed Sep. 30, 2019, the entire content of which is incorporated herein by reference.

BACKGROUND

Technical Field

The present disclosure relates to a method of manufacturing a coil component.

Background Art

A coil component in which a coil conductor is embedded in a magnetic portion has been known. Such a coil component is used, for example, as a power inductor or transformer.

For example, Japanese Patent Application Laid-Open No. 2019-106482 discloses a coil component including a body and a coil conductor embedded in the body, in which the body includes a first magnetic layer and a second magnetic layer that respectively configure a first main surface and a second main surface of the body facing each other. The first magnetic layer has a relative magnetic permeability higher than that of the second magnetic layer, at least a part of a winding part of the coil conductor is located in the first magnetic layer. Also, the first magnetic layer includes metal magnetic particles and a resin, the second magnetic layer includes metal magnetic particles, a resin, and zinc oxide particles, and the metal magnetic particles and the zinc oxide particles are dispersed in the resin.

SUMMARY

In the method of manufacturing the coil component disclosed in Japanese Patent Application Laid-Open No. 2019-106482, a sheet of the first magnetic layer is primarily pressed against a plurality of the coil conductors while holding the plurality of coil conductors in recesses of a mold. However, such a manufacturing method has the following problems.

(1) In order to embed the plurality of coil conductors in the sheet of the first magnetic layer with high positional accuracy, a mold having high dimensional accuracy of the recesses and positional accuracy between the recesses is required, which increases cost of manufacturing the mold.

(2) In order to make it easier to put the coil conductors in and out of the mold, it is necessary to provide a certain gap between each coil conductor and side walls of the recesses of the mold, or to provide the mold with a working mechanism for the coil conductors. Providing a certain gap between each coil conductor and the side walls of the recess of the mold will deteriorate the positional accuracy of the coil conductors, and providing the working mechanism for the coil conductors in the mold will complicate the mold.

(3) There are not many choices of a shape, size, number of coil, and the like of the coil conductors that can be disposed in the mold.

(4) When pressure during the primary press is high or wettability of the resin in the sheet of the first magnetic layer to the mold is high, a component obtained by the primary press is hard to be removed from the mold, which increases chances of breakage of the component.

(5) The mold is easily worn because the sheet of the first magnetic layer used for the primary press includes the metal magnetic particles.

Accordingly, the present disclosure provides a method of manufacturing a coil component in which press processing can be performed while holding a coil conductor with high positional accuracy without using a mold.

A method of manufacturing a coil component of the present disclosure includes the steps of arranging a plurality of coil conductors that is a wound body of a conductive wire and each has a first surface and a second surface opposing each other in a winding axis direction on a surface of an adhesive layer in contact with the first surface, and manufacturing a processed body in which a part of the coil conductors is embedded in the first magnetic sheet by placing the first magnetic sheet including a first metal magnetic particle and a first resin on a side of the second surface of each of the coil conductors disposed on the surface of the adhesive layer and performing press processing on the first magnetic sheet. The method also includes the steps of manufacturing an aggregate base body in which the coil conductors as a whole is embedded in a magnetic portion including the first magnetic sheet and the second magnetic sheet by peeling the processed body from the adhesive layer, and then placing a second magnetic sheet including a second metal magnetic particle and a second resin on a side of the first surface of each of the coil conductors, and performing the press processing the second magnetic sheet. The method further includes the step of manufacturing a body on a surface of which a part of each of the coil conductors is exposed by individualizing the aggregate base body.

The present disclosure is to provide a method of manufacturing a coil component in which press processing can be performed while holding a coil conductor with high positional accuracy without using a mold.

DETAILED DESCRIPTION

Hereinafter, a method of manufacturing a coil component of the present disclosure will be described. The present disclosure is not limited to the following configurations, and may be modified as appropriate without departing from the gist of the present disclosure. Further, a combination of a plurality of individual preferable configurations described below is also the present disclosure.

[Method of Manufacturing Coil Component]

Each step of one example of the method of manufacturing a coil component of the present disclosure will be described with reference to the drawings.

<Step of Manufacturing Coil Conductor>

Figure 1:
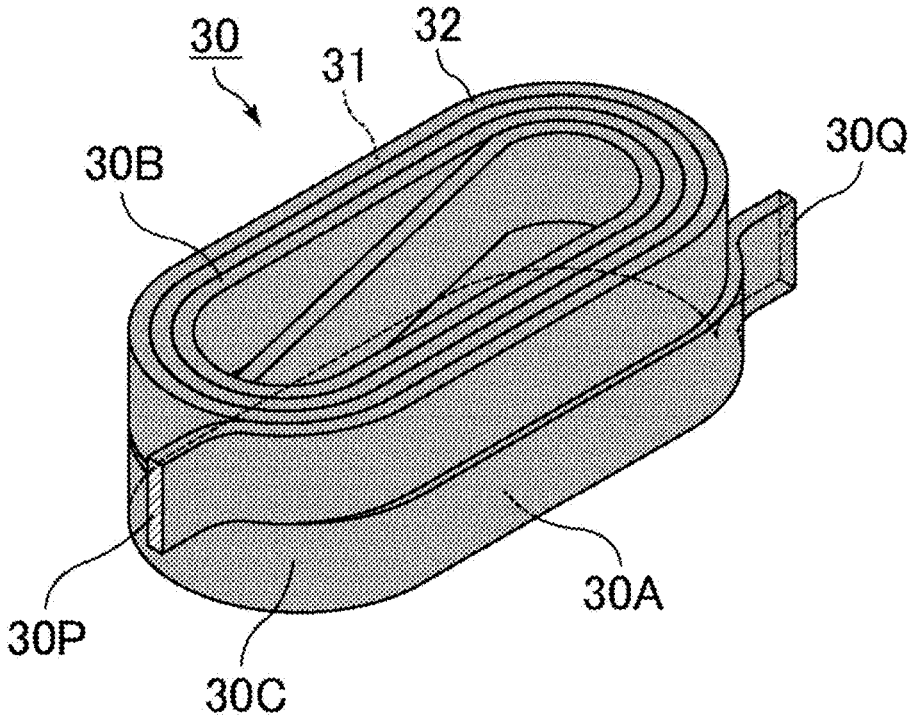
FIG. 1 is a schematic perspective view for explaining one example of a step of manufacturing a coil conductor.

FIG. 1 is a schematic perspective view for explaining one example of a step of manufacturing a coil conductor.

As shown in FIG. 1, a rectangular strip-shaped conductive wire 31 is α-wound. As a result, an air core-shaped, so-called α-wound coil conductor 30, which is a wound body of the conductive wire 31, is manufactured.

Examples of a method of winding the coil conductor 30 include edgewise winding, swirl winding, and spiral winding, in addition to α-winding.

Examples of a shape of the conductive wire 31 include a round wire shape and a square wire shape in addition to a rectangular strip shape.

A material of the conductive wire 31 is preferably an electrochemically nobler material than iron, and examples thereof include metals such as copper.

The conductive wire 31 may be covered with an insulating film 32 as shown in FIG. 1.

Examples of a material of the insulating film 32 include insulating resins such as polyimide resin and polyester resin.

When the coil conductor 30 is manufactured, the conductive wire 31 may be wound with a fusing agent in between. The fusing agent functions as an adhesive for holding a winding state of the conductive wire 31.

Examples of a material of the fusing agent include a thermoplastic resin whose main component is a polyamide resin or the like.

The coil conductor 30 has a first surface 30A and a second surface 30B facing each other in the winding axis direction (vertical direction in FIG. 1), and a side surface 30C parallel to the winding axis direction.

A first end 30P and a second end 30Q of the coil conductor 30 are provided so as to project in directions opposite from the side surface 30C. The conductive wire 31 is exposed at the first end 30P and the second end 30Q of the coil conductor 30.

<Step of Manufacturing Magnetic Sheet>

Figure 2:
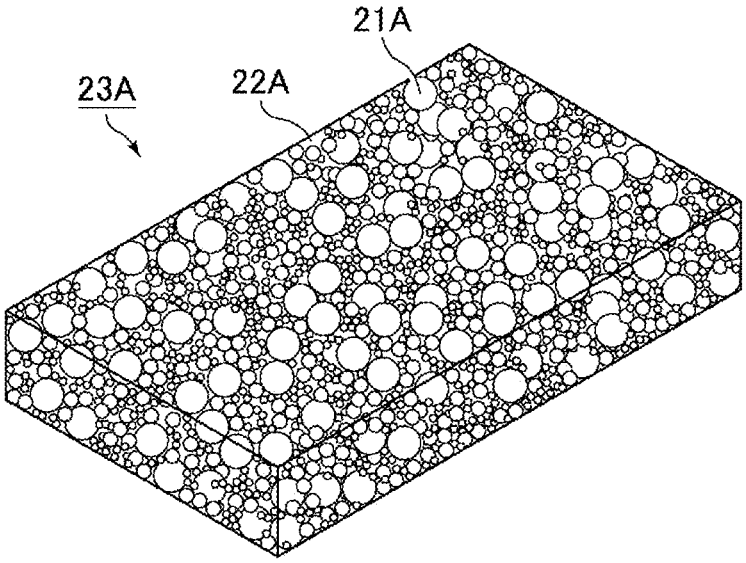
FIG. 2 is a schematic perspective view for explaining one example of a step of manufacturing a magnetic sheet.
Figure 3:
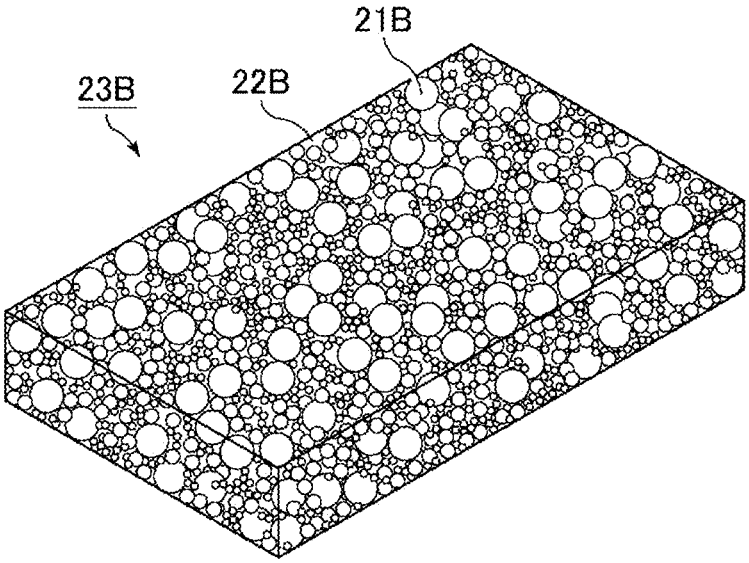
FIG. 3 is a schematic perspective view for explaining one example of the step of manufacturing the magnetic sheet.

FIGS. 2 and 3 are schematic perspective views for explaining one example of a step of manufacturing a magnetic sheet.

First, the metal magnetic particles and a resin are mixed in a wet state to prepare a slurry. Then, the obtained slurry is molded by a doctor blade method or the like and then dried. As a result, a first magnetic sheet 23A is manufactured in which first metal magnetic particles 21A are dispersed in a first resin 22A as shown in FIG. 2. Similarly, as shown in FIG. 3, a second magnetic sheet 23B is manufactured in which second metal magnetic particles 21B are dispersed in a second resin 22B.

Examples of the first metal magnetic particles 21A and the second metal magnetic particles 21B include iron-based soft magnetic particles such as α-iron, iron-silicon alloy, iron-silicon-chromium alloy, iron-silicon-aluminum alloy, iron-nickel alloy, and iron-cobalt alloy.

Forms of the first metal magnetic particles 21A and the second metal magnetic particles 21B are preferably amorphous having good soft magnetism, but may be crystalline.

As the first metal magnetic particles 21A, a plurality of types of metal magnetic particles having different average particle sizes $D_{50}$ may be used in combination. This helps improve filling efficiency of the first metal magnetic particles 21A in a magnetic portion 20 described later, and consequently helps obtain high inductance. Examples of a combination of such metal magnetic particles include a combination of metal magnetic particles having a smaller average particle size $D_{50}$ of 1 μm or more and 20 μm or less (i.e., from 1 μm to 20 μm) and a larger average particle size $D_{50}$ of 10 μm or more and 40 μm or less (i.e., from 10 μm to 40 μm).

As the second metal magnetic particles 21B, a plurality of types of metal magnetic particles having different average particle sizes $D_{50}$ may be used in combination. This helps improve filling efficiency of the second metal magnetic particles 21B in the magnetic portion 20 described later, and consequently helps obtain high inductance. Examples of a combination of such metal magnetic particles include a combination of metal magnetic particles having a smaller average particle size $D_{50}$ of 1 μm or more and 20 μm or less (i.e., from 1 μm to 20 μm) and a larger average particle size $D_{50}$ of 10 μm or more and 40 μm or less (i.e., from 10 μm to 40 μm).

A particle size distribution of the metal magnetic particles is measured by a laser diffraction and scattering method and expressed by an integrated % with respect to a particle size scale. The average particle size $D_{50}$ of the metal magnetic particles is determined as a particle size having an integrated value of 50%.

A content of the first metal magnetic particles 21A in the first magnetic sheet 23A is preferably 96% by weight or more. When the content of the first metal magnetic particles 21A in the first magnetic sheet 23A in the magnetic portion 20 is less than 96% by weight, a magnetic property such as magnetic permeability or magnetic flux saturation density may deteriorate in the magnetic portion 20 described later. Further, a content of the first metal magnetic particles 21A in the first magnetic sheet 23A is preferably 98% by weight or less. When the content of the first metal magnetic particles 21A in the first magnetic sheet 23A is more than 98% by weight, a content of the first resin 22A decreases. Thus, fluidity of the first metal magnetic particles 21A decreases during formation of the magnetic portion 20 described later, and a packing density of the first metal magnetic particles 21A in the magnetic portion 20 described later is unlikely to increase. As a result, the magnetic permeability, inductance, or the like may decrease in the magnetic portion 20 described later.

Similarly, a content of the second metal magnetic particles 21B in the second magnetic sheet 23B is preferably 96% by weight or more. Further, a content of the second metal magnetic particles 21B in the second magnetic sheet 23B is preferably 98% by weight or less.

The type of the first metal magnetic particles 21A and the type of the second metal magnetic particles 21B may be different from each other or may be the same.

Examples of the first resin 22A and the second resin 22B include epoxy resin, phenol resin, polyester resin, polyimide resin, and polyolefin resin.

The type of the first resin 22A and the type of the second resin 22B may be different from each other or may be the same.

The type of the resin in the magnetic sheets can be confirmed by exposing cross sections of the magnetic sheets and then performing element analysis by a transmission electron microscope-energy dispersive X-ray analysis (TEM-EDX).

A thickness of the first magnetic sheet 23A and a thickness of the second magnetic sheet 23B are, for example, 100 μm or more and 300 μm or less (i.e., from 100 μm to 300 μm).

<Step of Arranging Adhesive Layer>

Figure 4:
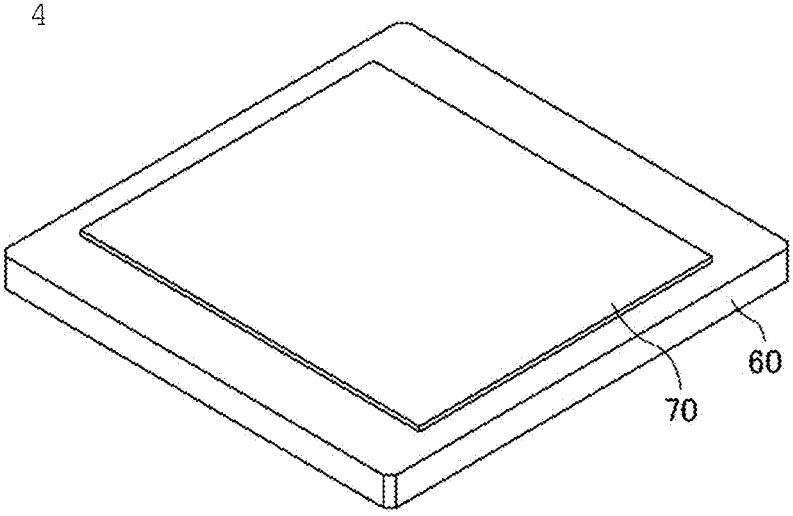
FIG. 4 is a schematic perspective view for explaining one example of a step of arranging an adhesive layer.

FIG. 4 is a schematic perspective view for explaining one example of a step of arranging an adhesive layer.

As shown in FIG. 4, an adhesive sheet 70 as an adhesive layer is attached to and disposed on a surface plate 60.

Examples of a material of the surface plate 60 include metal and glass.

The adhesive sheet 70 is processed by molding an adhesive into a sheet. That is, a surface of the adhesive sheet 70 on a side of the surface plate 60 and the surface of the adhesive sheet 70 on a side opposite to the surface plate 60 are adhesive surfaces. The surface of the adhesive sheet 70 on the side of the surface plate 60 may be fixed to the surface plate 60 by a method other than adhesion.

Examples of an adhesive of the adhesive sheet 70 include acrylic adhesives, silicone adhesives, natural rubber adhesives, urethane adhesives, and polyolefin adhesives.

Adhesive strength of the adhesive is preferably not changed with time, but may be changed with time.

In a method of arranging the adhesive layer, instead of attaching the adhesive sheet 70 to the surface plate 60, for example, the adhesive agent coated on a base sheet may be fixed to the surface plate 60, or the adhesive may be applied directly to the surface plate 60. Alternatively, the adhesive layer may be prepared by immersing the base sheet in a liquid thermosetting adhesive and then solidifying the base sheet.

<Step of Arranging Coil Conductor>

Figure 5:
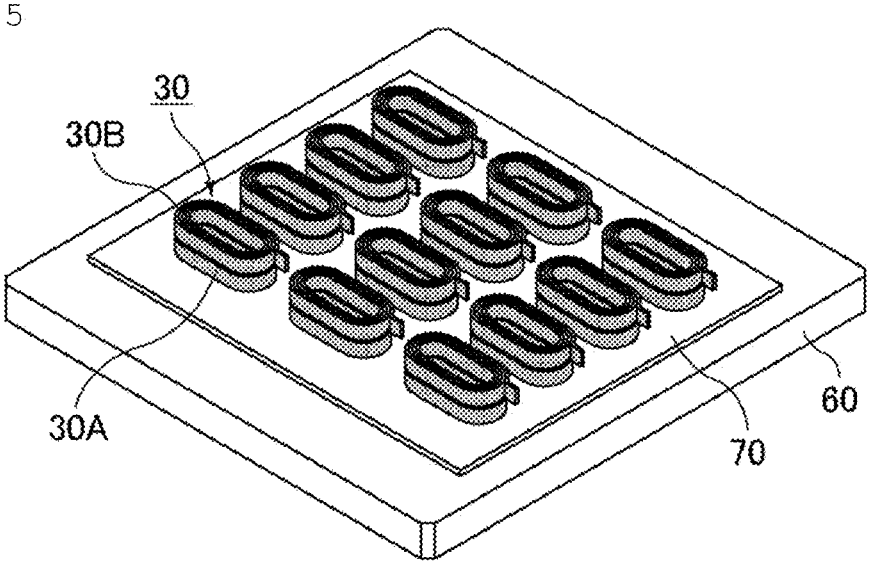
FIG. 5 is a schematic perspective view for explaining one example of a step of arranging a coil conductor.

FIG. 5 is a schematic perspective view for explaining one example of a step of arranging a coil conductor.

As shown in FIG. 5, a plurality of the coil conductors 30 are arranged on the surface of the adhesive sheet 70 with which the first surface 30A is in contact.

By arranging the plurality of coil conductors 30 on the surface of the adhesive sheet 70, the coil conductors 30 are fixed at a position when the coil conductors 30 contact the adhesive sheet 70. Thus, the coil conductors 30 can be held with high positional accuracy. Further, the adhesive sheet 70 is used to hold the coil conductors 30 instead of a mold, thereby suppressing a manufacturing cost and enhancing versatility. There are more choices of a shape, size, number, and the like of the coil conductors 30 that can be disposed because no mold is required.

<Step of Manufacturing Processed Body>

Figure 6:
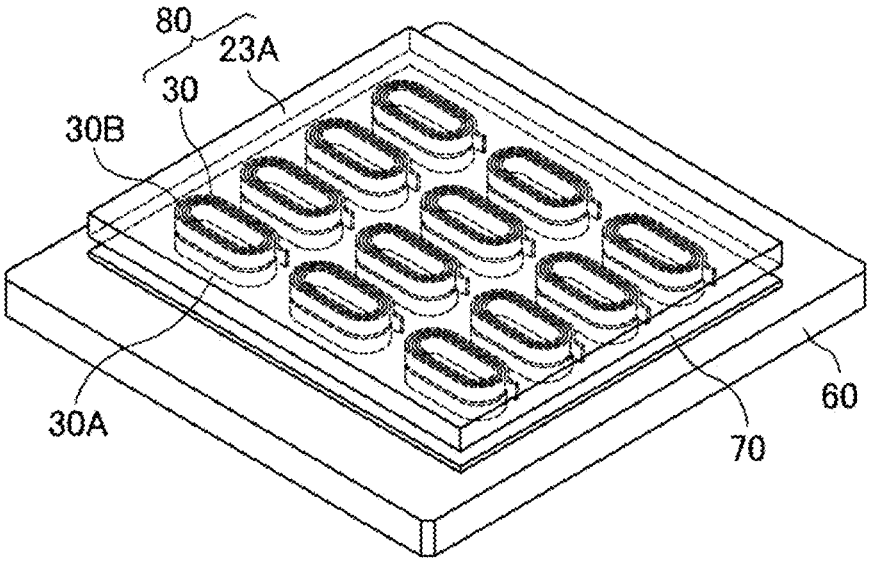
FIG. 6 is a schematic perspective view for explaining one example of a step of manufacturing a processed body.

FIG. 6 is a schematic perspective view for explaining one example of a step of manufacturing a processed body.

As shown in FIG. 6, the first magnetic sheet 23A is placed on a side of the second surface 30B of the coil conductor 30 disposed on the surface of the adhesive sheet 70, and press processing is performed. A processed body 80 is thus manufactured in which a part of the coil conductor 30, which is here, a part including the second surface 30B of the coil conductor 30, is embedded in the first magnetic sheet 23A. When the processed body 80 is manufactured, the coil conductor 30 may be embedded such that only the first surface 30A is exposed from the first magnetic sheet 23A.

When the processed body 80 is manufactured, there is a concern that a holding function of the adhesive sheet 70 may be deteriorated due to a load or the like during the press processing. Thus, when the processed body 80 is manufactured, it is preferable to apply a pressing thrust in a direction parallel to the winding axis direction of the coil conductor 30 to perform the press processing. In this case, the pressing thrust is applied to upper and lower pressing surfaces parallel to the adhesive surface of the adhesive sheet 70 in contact with the first surface 30A of the coil conductor 30. By applying the pressing thrust in this manner significantly suppresses positional displacement of the coil conductor 30 in a direction perpendicular to the winding axis direction during the press processing, thereby maintaining the high positional accuracy of the coil conductor 30.

When the processed body 80 is manufactured, the adhesive sheet 70 is used to hold the coil conductor 30 as described above, thereby eliminating the need for using a mold which is easily worn during the press processing.

When the processed body 80 is manufactured, hot press processing may be performed as the above press processing. As a result, the processed body 80 can be manufactured while the first magnetic sheet 23A is solidified to some extent. A temperature during the hot press processing is preferably a temperature at which the first resin 22A in the first magnetic sheet 23A flows. For example, when the first resin 22A is an epoxy resin, the temperature during the hot press processing is preferably 100° C. or higher.

When the processed body 80 is manufactured, press molding may be performed as the above press processing. That is, when the processed body 80 is manufactured, hot press molding may be performed as the above hot press processing.

<Step of Peeling Processed Body>

Figure 7:
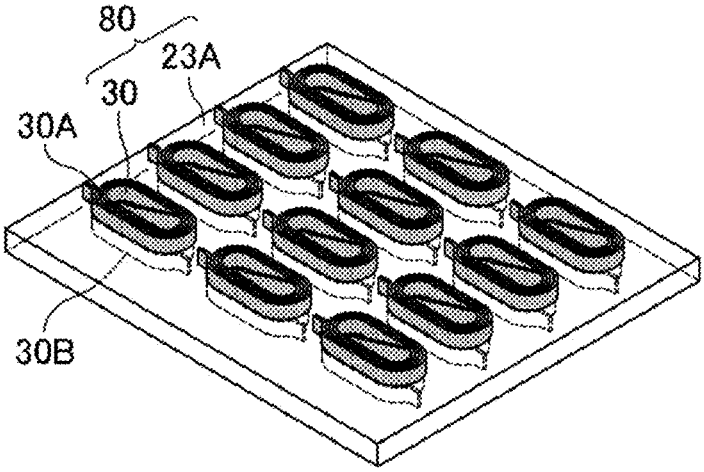
FIG. 7 is a schematic perspective view for explaining one example of a step of peeling the processed body.

FIG. 7 is a schematic perspective view for explaining one example of a step of peeling a processed body.

The processed body 80 is peeled off from the adhesive sheet 70 and inverted as shown in FIG. 7.

When pressure during the press processing is increased or the number of presses is increased in the step of manufacturing the processed body, adhesive force between the processed body 80 and the adhesive sheet 70 may be increased, and the processed body 80 may be less likely to be peeled off from the adhesive sheet 70. However, the adhesive force between the processed body 80 and the adhesive sheet 70 can be controlled by a physical property of the adhesive sheet 70, and thus the processed body 80 can be easily peeled off from the adhesive sheet 70 although the pressure during the press processing in the step of manufacturing the processed body is increased or the number of presses is increased. Using the adhesive sheet 70 makes it possible to increase the pressure during the press processing or increase the number of presses in the step of manufacturing the processed body without a concern about deteriorating ease of peeling of the processed body 80. When the pressure during the press processing in the step of manufacturing the processed body is increased or the number of presses is increased, the first metal magnetic particles 21A in the first magnetic sheet 23A are consolidated, and the magnetic properties such as the magnetic permeability and the magnetic flux saturation density are improved in the magnetic portion 20 described later.

<Step of Manufacturing Aggregate Base Body>

Figure 8:
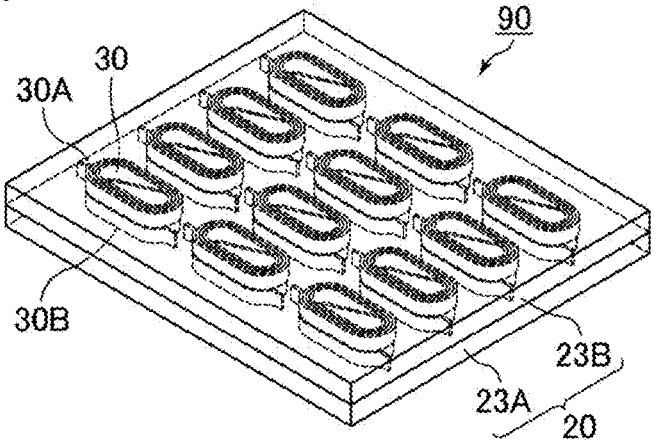
FIG. 8 is a schematic perspective view for explaining one example of a step of manufacturing an aggregate base body.

FIG. 8 is a schematic perspective view for explaining one example of a step of manufacturing an aggregate base body.

As shown in FIG. 8, the second magnetic sheet 23B is placed on the first surface 30A of the coil conductor 30, and the press processing is performed. Thus, a part of the coil conductor 30 that is not embedded in the first magnetic sheet 23A, which is here, a part including the first surface 30A of the coil conductor 30, is embedded in the second magnetic sheet 23B. As a result, an aggregate base body 90 is manufactured in which the whole coil conductor 30 is embedded in the magnetic portion 20 as a laminated body of the first magnetic sheet 23A and the second magnetic sheet 23B.

The magnetic portion 20 includes the first metal magnetic particles 21A derived from the first magnetic sheet 23A and second metal magnetic particles 21B derived from the second magnetic sheet 23B. Further, the magnetic portion 20 includes the first resin 22A derived from the first magnetic sheet 23A and the second resin 22B derived from the second magnetic sheet 23B.

The magnetic portion 20 may have a single-layer structure or a multilayer structure. For example, when the types of the first metal magnetic particles 21A derived from the first magnetic sheet 23A and the second metal magnetic particles 21B derived from the second magnetic sheet 23B are different from each other, or when the types of the first resin 22A derived from the first magnetic sheet 23A and the second resin 22B derived from the second magnetic sheet 23B are different from each other, the magnetic portion 20 has a two-layer structure.

When the aggregate base body 90 is manufactured, the hot press processing may be performed as the above press processing. As a result, the aggregate base body 90 can be manufactured while the second magnetic sheet 23B is solidified to some extent. The temperature during the hot press processing is preferably a temperature at which the second resin 22B in the second magnetic sheet 23B flows. For example, when the second resin 22B is an epoxy resin, the temperature during the hot press processing is preferably 100° C. or higher.

When the aggregate base body 90 is manufactured, the press molding may be performed as the above press processing. That is, when the aggregate base body 90 is manufactured, the hot press molding may be performed as the above hot press processing.

<Step of Manufacturing Body>

Figure 9:
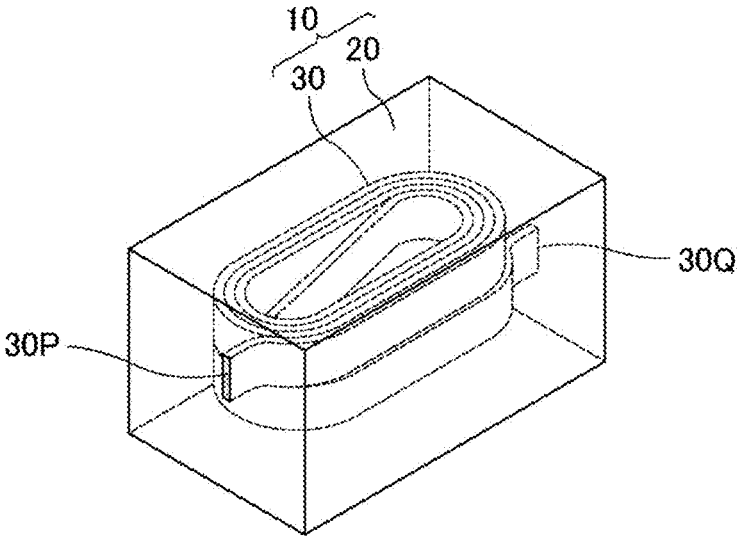
FIG. 9 is a schematic perspective view for explaining one example of the step of manufacturing the body.

FIG. 9 is a schematic perspective view for explaining one example of a step of manufacturing a body.

The aggregate base body 90 is separated into pieces using a cutting tool such as a dicer. Thus, as shown in FIG. 9, there is manufactured the body 10 on a surface of which a part of the coil conductor 30 is exposed or here, the body 10 in which the first end 30P of the coil conductor 30 is exposed on the first end face, and the second end 30Q of the coil conductor 30 is exposed on a second end face.

The body 10 has a magnetic portion 20 and a coil conductor 30 embedded in the magnetic portion 20.

<Step of Forming External Electrode>

Figure 10:
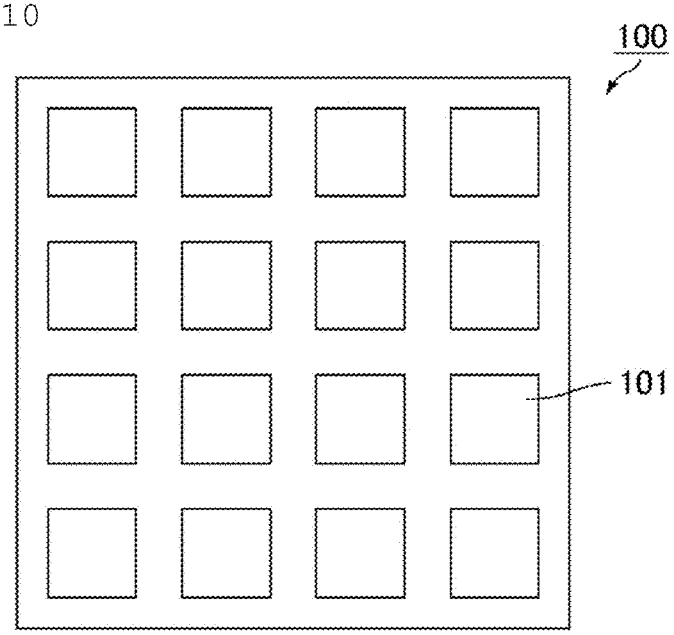
FIG. 10 is a schematic plan view showing a holder for the body used in one example of a step of forming an external electrode.
Figure 11:
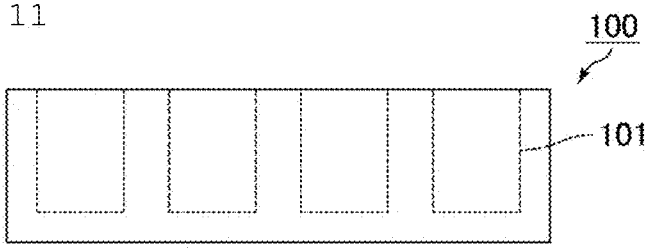
FIG. 11 is a schematic side view of the holder shown in FIG. 10.

FIG. 10 is a schematic plan view showing a holder for the body used in one example of a step of forming an external electrode. FIG. 11 is a schematic side view of the holder shown in FIG. 10. FIGS. 12 to 16 are schematic side views for explaining one example of the step of forming an external electrode.

First, as shown in FIGS. 10 and 11, a holder 100 provided with a plurality of holes 101 capable of holding a body 10 is prepared.

Next, the body 10 is barrel-polished in water or in the air to be chamfered. Then, the body 10 is washed.

Figure 12:
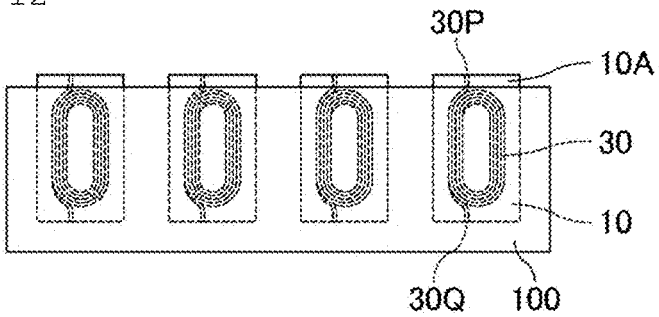
FIG. 12 is a schematic side view for explaining one example of the step of forming the external electrode.
Figure 13:
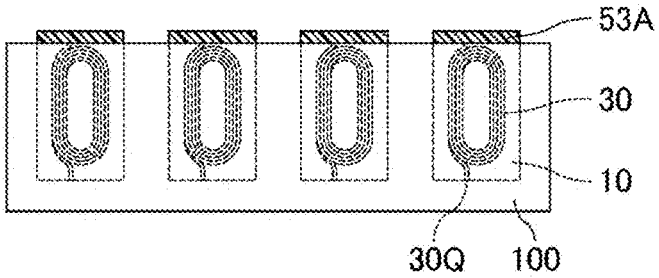
FIG. 13 is a schematic side view for explaining one example of the step of forming the external electrode.

Next, as shown in FIG. 12, the body 10 is held in each hole 101 of the holder 100 such that a first end 10A of the body 10 projects from the holder 100. Subsequently, by immersing the holder 100 holding the body 10 in a conductive solution, as shown in FIG. 13, a first conductive layer 53A is formed at the first end 10A of the body 10. Here, the first end 30P of the coil conductor 30 is exposed on a surface of the first end 10A of the body 10, and thus the first end 30P of the coil conductor 30 is connected to the first conductive layer 53A.

Figure 14:
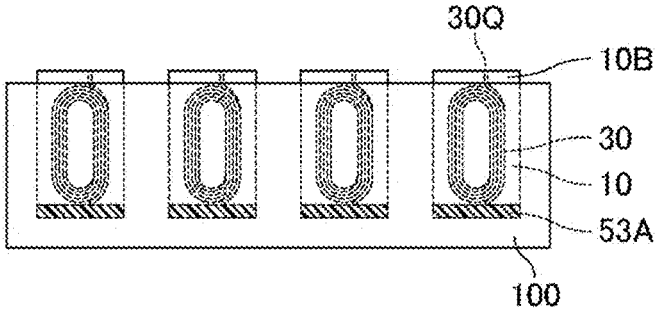
FIG. 14 is a schematic side view for explaining one example of the step of forming the external electrode.
Figure 15:
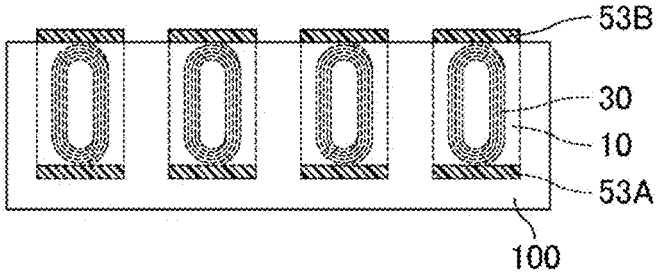
FIG. 15 is a schematic side view for explaining one example of the step of forming the external electrode.

Next, the body 10 is taken out of the holder 100, and as shown in FIG. 14, the body 10 is held in each hole 101 of the holder 100 such that a second end 10B of the body 10 projects from the holder 100. Subsequently, by immersing the holder 100 holding the body 10 in a conductive solution, as shown in FIG. 15, a second conductive layer 53B is formed at the second end 10B of the body 10. Here, the second end 30Q of the coil conductor 30 is exposed on a surface of the second end 10B of the body 10, and thus the second end 30Q of the coil conductor 30 is connected to the second conductive layer 53B.

A conductive material included in the conductive solution is not particularly limited as long as the conductive material can form a plating film by electrolytic plating described later, and examples of the conductive material include palladium, tin, silver, and alloys thereof.

Figure 16:
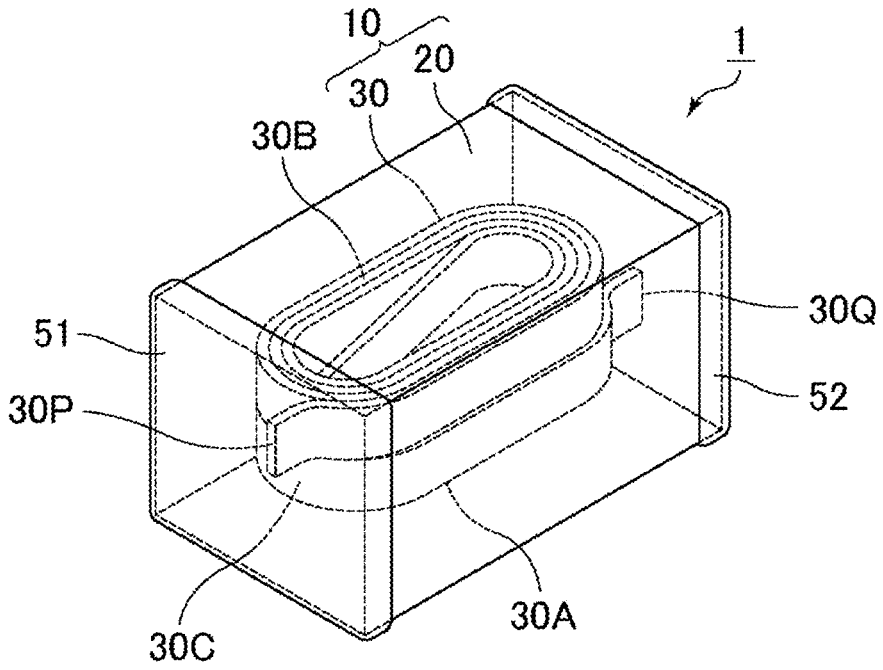
FIG. 16 is a schematic side view for explaining one example of the step of forming the external electrode.

Next, after the body 10 is taken out of the holder 100, the body 10 is subjected to electrolytic plating, and, for example, a first plating film, a second plating film, and a third plating film are sequentially laminated on surfaces of the first conductive layer 53A and the second conductive layer 53B. Thus, as shown in FIG. 16, a first external electrode 51 connected to the first end 30P of the coil conductor 30 and a second external electrode 52 connected to the second end 30Q of the coil conductor 30 are formed on the surface of the body 10.

The first external electrode 51 is provided on the surface of the body 10, and more specifically, is provided so as to extend to a first end face of the body 10 and a part of each of four faces adjacent to the first end face. Further, the first external electrode 51 is connected to the first end 30P of the coil conductor 30, and more specifically, is connected to the conductive wire 31 exposed at the first end 30P of the coil conductor 30.

The first external electrode 51 may have a single-layer structure or a multilayer structure. For example, when the first plating film mainly includes copper, the second plating film mainly includes nickel, and the third plating film mainly includes tin, then, the first external electrode 51 has a three-layer structure.

The second external electrode 52 is provided on the surface of the body 10, and more specifically, is provided so as to extend to a second end face of the body 10 and a part of each of four faces adjacent to the first end face. Further, the second external electrode 52 is connected to the second end 30Q of the coil conductor 30, and more specifically, is connected to the conductive wire 31 exposed at the second end 30Q of the coil conductor 30.

The second external electrode 52 may have a single-layer structure or a multilayer structure. For example, when the first plating film mainly includes copper, the second plating film mainly includes nickel, and the third plating film mainly includes tin, then, the second external electrode 52 has a three-layer structure.

A type of the material of the first external electrode 51 and a type of the material of the second external electrode 52 may be different, but are preferably the same.

As described above, the coil component 1 having the body 10, the first external electrode 51, and the second external electrode 52 as shown in FIG. 16 is manufactured.

What is claimed is:

1. A method of manufacturing a coil component, comprising:

arranging a plurality of coil conductors on a surface of an adhesive layer, wherein each of the plurality of coil conductors is a wound body of a conductive wire and has a first surface and a second surface opposing each other in a winding axis direction, and the plurality of coil conductors are arranged such that the first surface of each of the coil conductors is in contact with the surface of the adhesive layer;

manufacturing a processed body by placing a first magnetic sheet including a first metal magnetic particle and a first resin on the second surface of each of the coil conductors disposed on the surface of the adhesive layer, pressing the first magnetic sheet on the second surface of each of the coil conductors such that the first magnetic sheet remains spaced from the surface of the adhesive layer, and then manufacturing the processed body in which a part of the coil conductors is embedded in the first magnetic sheet;

manufacturing an aggregate base body by, after peeling the processed body from the adhesive layer, placing a second magnetic sheet including a second metal magnetic particle and a second resin on the first surface of each of the coil conductors, pressing the second magnetic sheet on the first surface of each of the coil conductors, and then manufacturing the aggregate base body in which each of the coil conductors as a whole is embedded in a magnetic portion including the first magnetic sheet and the second magnetic sheet; and manufacturing a body by individualizing the aggregate base body into individual pieces of the body, and manufacturing the body on a surface of which a part of each of the coil conductors is exposed.

2. The method of manufacturing a coil component according to claim 1, wherein in the manufacturing of the processed body, the pressing is performed by applying a pressing thrust in a direction parallel to the winding axis direction of the plurality of coil conductors.

3. The method of manufacturing a coil component according to claim 1, wherein in the manufacturing of the processed body and the manufacturing of the aggregate base body, a hot press processing is performed.

4. The method of manufacturing a coil component according to claim 2, wherein in the manufacturing of the processed body and the manufacturing of the aggregate base body, a hot press processing is performed.

5. The method of manufacturing a coil component according to claim 1, further comprising:

forming a conductive layer on the surface at which the part of each of the coil conductors is exposed.

6. The method of manufacturing a coil component according to claim 1, wherein the adhesive layer is on a plate.

* * * * *